United States Patent [19]

Kopp et al.

[11] Patent Number: 4,788,842

[45] Date of Patent: Dec. 6, 1988

[54] OPEN-DIE FORGING METHOD

[75] Inventors: Reiner Kopp; Klaus-Rainer Baldner; Paul-Josef Nieschwitz, all of Aachen, Fed. Rep. of Germany

[73] Assignee: SMS Hasenclever Maschinenfabrik GmbH, Dusseldorf, Fed. Rep. of Germany

[21] Appl. No.: 938,238

[22] Filed: Dec. 5, 1986

[30] Foreign Application Priority Data

Dec. 5, 1985 [DE] Fed. Rep. of Germany ..... 3542966

[51] Int. Cl.[4] ..... B21J 3/00

[52] U.S. Cl. ..... 72/45

[58] Field of Search ..... 72/39, 40, 43, 44, 45, 72/42, 364, 41

[56] References Cited

U.S. PATENT DOCUMENTS

| | | | |
|---|---|---|---|
| 3,140,779 | 7/1964 | Dalton et al. | 72/42 |
| 3,254,401 | 6/1966 | Dalton et al. | 72/42 X |
| 3,561,238 | 2/1971 | Tetzloff et al. | 72/45 X |
| 3,756,051 | 9/1973 | Rebsamen et al. | 72/45 X |
| 3,840,461 | 10/1974 | Espunes | 72/42 X |

FOREIGN PATENT DOCUMENTS

| | | | |
|---|---|---|---|
| 1804652 | 5/1970 | Fed. Rep. of Germany | 72/45 |
| 2515222 | 11/1975 | Fed. Rep. of Germany . | |

OTHER PUBLICATIONS

Extruding Metals with Glass Lubricants, J. Delcroix Metal Progress, Jan. 1956, pp. 57–60.

*Metals Handbook*, 8th ed., vol. 5, American Society for Metals, Cleveland, (1970) pp. 41–43, 49, 53, 69, 74, 99, 101, 113, 117–118.

"Presses and Hammers", Schloemann AG, Dusseldorf, (1964) pp. 1–10.

Wehmeyer, W., "A New Lubricant and Protective Agent for thw Deformation of Steel in Rod and Tube Extrusion Presses", Schloemann AG, Dusseldorf, (Translation into English from Blech 11), (1964) pp. 1–11.

Wehmeyer, W., "Eine Neues Schutz-und Schmiermittal zum Unformen von Stahl in Strang-und Rohrpressen", (reprint from Blech 11), (1964), vol. 9.

"Open-die forghing plants", SMS Schloemann-Siemag AG, Dusseldorf, (1980) pp. 1–26.

*Primary Examiner*—E. Michael Combs

*Attorney, Agent, or Firm*—Holman & Stern

[57] ABSTRACT

The invention relates to a method and apparatus for open-die forging of workpieces in forging presses at high forging temperatures, more particularly steel billets or ferrous alloy billets between about 800 and 1250 degrees Celsius. In conventional open-die forging it is often not possible to complete the forging process in a single heat, and the workpiece must therefore be reheated. Also, with direct contact between workpiece and tool, cracks occur, particularly in the vicinity of bulges, the prevention or straightening of which requires repeated transverse hammer- or pressure-forging, so lengthening the cooling time. The total energy consumption for deformation and heating of the workpieces is therefore relatively high. Reduction of this energy consumption, a surprising improvement in product quality, and almost complete elimination of bulges are achieved by means of the invention, in that during forging the workpiece undergoes lubrication effective at the forging temperature, the lubricant being a fluid glass film. The lubricant is advantageously applied in the form of a fine powder.

24 Claims, 1 Drawing Sheet

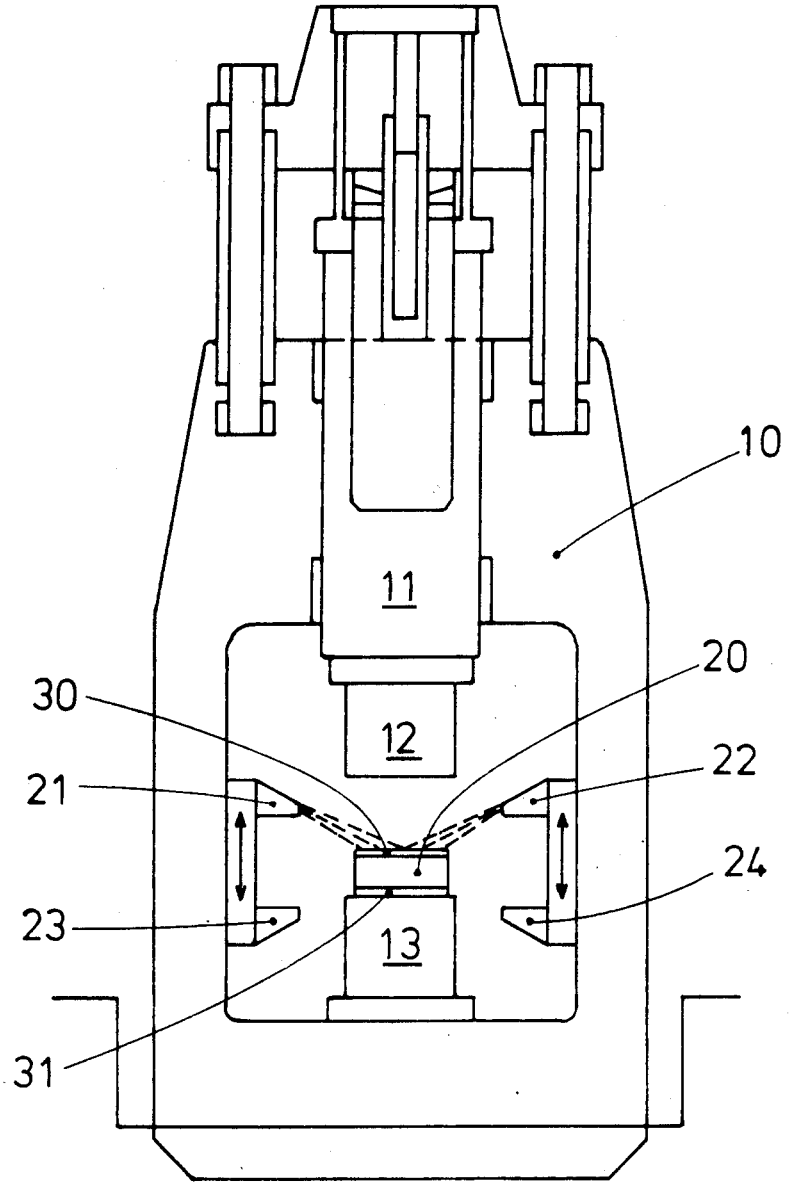
10
11
12
13
20
21
22
23
24
30
31

OPEN-DIE FORGING METHOD

BACKGROUND OF THE INVENTION

The invention relates to a method and apparatus for open-die forging of workpieces in forging presses at high forging temperatures, more particularly steel billets or ferrous alloy billets at forging temperatures between about 800 and 1250 degrees Celsius.

When workpieces, that is, metal billets heated to forging temperature, undergo open-die forging in a forging press, considerable bulging may occur during hammer- or pressure-forging, and cracks may form in the exposed sides of the workpiece. To straighten these undesirable bulges, the workpiece must be turned and the bulges pressed down. These measures may worsen surface quality, and above all they take time. The loss of time often also causes the forging temperature to drop below the acceptable minimum, so that the workpiece must be reheated, so increasing both energy consumption and cost. Lubrication for open-die forging is not known in the prior art.

In extrusion and closed die-forging, on the other hand, it is known for glass to be used as a lubricant. This applies both for high deformation temperatures of about 1100 to 1250 degrees Celsius and for the hot forming range. For example, the periodical "Blech" 11 (1964), volume 9, describes glass or glass-like materials as protection and lubrication during steel forming in pipe and other extrusion presses. The protective and lubricant glass between the hot, plastically deformable metal and the cooler steel of the tools forms a more or less thin film, and slides past the forming tools with the plastically deformed steel. The use of lubricants reduces friction and energy consumption.

The viscosity or plasticity of the glass film reduces the friction coefficient to a value of 0.05, whereas the value would be about 0.12 if the plastic steel were forged without glass lubrication. The heat losses are reduced, and at the same time the tools are protected because the quantity of heat transmitted to the press tools is substantially reduced with glass lubrication, because the thermal conductivity of a viscous or plastic glass film is some 10 to 60 times less than that of an equally thick layer of plastic steel.

German Offenlegungsschrift No. 25 15 222, moreover, describes a method of high-temperature die-forging in which a glass lubricant not more than 25um thick is applied to the surface of the blank. This glass film known in the extrusion art is very thin and therefore tears easily, in which case lubrication is no longer adequate.

An object of the invention is to affect the material flow in the workpiece in open-die forging in a reproducible and operationally reliable manner, and to reduce the total energy consumption for the deformation and heating or re-heating of the workpieces, while at the same time improving the product quality, eliminating in particular bulging and crack formation. A partial object of the invention is also to demonstrate the essential parameters for optimum material flow conditions under operation conditions.

SUMMARY OF THE INVENTION

The object is achieved, in accordance with the invention, in that during forging the workpiece undergoes lubrication effective at the forging temperature. This prevents any metal contact between the sliding surfaces of the tool and workpiece and hence any cold welding, mechanical abrasion and the bulges associated with cracking. Sharp edges and smooth surfaces are almost entirely preserved during deformation. At the same time, and with only slight bulging, the spreading action is improved, the flow in the workpiece during open-die forging being promoted. The use of a lubricant also permits increased reductions per pass, even, for example, where force limitations are imposed by the equipment. The lubricant also has the advantage of preventing overstretching at the tool edges (with the risk of cracking at these sites).

In a particularly advantageous embodiment of the invention, the lubrication is by means of a glass film which is fluid at the forging temperature. In other types of metal deformation, particularly extrusion, this technique has given good results in both the viscous and the plastic ranges. By applying this knowledge judiciously it is possible to reduce the time for further process optimisation by inference from analogous experience. Overall, moreover, the surface properties of the billet are much improved, due to the formation of near metal surfaces without layers of scale.

According to another feature of the invention, the lubrication is effective on all contact surfaces between the workpiece and tool. This optimises the use of the lubricant, as only surfaces exposed to a load receive a film of lubricant.

Advantageously, also, the lubricant is applied to the workpiece immediately before forging begins. Contact times between the lubricant film and workpiece can thus be minimised, in order to exclude any undesirable chemical surface reactions.

According to another advantageous embodiment of the invention, the lubricant is applied to powder form as a surface covering. This glass powder may, for example, be sprinkled, blown or sprayed on. Distribution in this way is particularly suited to the application of relatively thick layers. It is especially advantageous if the grain size of the glass powder used as lubricant is less than 80 $\mu$m, and preferably less than 40 $\mu$m. Best results were obtained when the thickness of the lubricant covering was between approximately 100 and 300 $\mu$m.

In addition, the lubricant may be applied to the workpiece in an aqueous solution. This gives very thin coverings.

It may also be convenient if the lubricant is applied in a plurality of layers. This has the advantage of allowing optimum adjustment of the lubricant action.

The solidified lubricant may be removed by sand blasting. Solidified glass coverings usually crack off of their own accord or, at the latest, during finishing; this produces, surprisingly, a near-metalic surface on the billet. The few remaining traces can be removed very easily and inexpensively by sand blasting.

This invention also provides a forging press which includes means for uniformly applying the lubricant layers to the workpiece as a surface covering, provided in the vicinity of the opening of the press frame. The said applying means may, for example, be a hopper which has a slot-type opening, covers the width of the workpiece and is connected to the upper saddle. Advantageously, the workpiece is then coated bit by bit during the advance, possibly by turning the workpiece.

Advantageously, in another embodiment of the invention, the means for applying the lubricant layers to the workpiece comprises upper nozzles and lower nozzles which are vertically movable. In this way the workpiece can receive its surface covering from several directions simultaneously, in a well-directed manner and a short time.

Further details, features and advantages of the invention will be apparent from the ensuring description of an embodiment illustrated diagrammatically in the drawing.

The FIGURE illustrates diagrammatically, and by way of example also for other forms of press, a forging press without a travelling crosshead and having an above-floor drive.

DESCRIPTION OF PREFERRED EMBODIMENTS

In a press frame 10 a cylinder 11 is vertically movable in a known manner. An upper saddle carrier with an upper saddle 12 is releasably and positively connected to the cylinder 11. The upper saddle 12 co-operates with a lower saddle carrier and lower saddle 13. Between them is the workpiece 20 to be forged, which a manipulator (not shown) inserts in the press frame and holds. As soon as the metal billet 20 from the manipulator arrives between the upper and lower saddles 12, 13 and within range of upper and lower nozzles 21 to 24, a suitable glass powder is sprayed onto the workpiece 20 to form a surface covering. The glass powder may, for example, have the following composition: $SiO_2$ min. 70%; $A1_2O_3$ 0.5 to 2%; CaO 8%; MgO 3 to 5%; $Fe_2O_3$ max. 0.1%; $Na_2O+K_2O$ 13 to 15%. Advantageously, very fine powders are used, for example with a grain size between 0.04 and 0.08 mm or less.

Because the melting point of the glass powder is low (lower than the surface temperature of the workpiece 20), there forms on both sides of the workpiece 20 a fluid lubricant film 30, 31 between 0.1 and 0.3 mm thick. (The thicknesses of the lubricant film are not shown to scale in the drawing.) The coated workpiece 20 is placed on the lower saddle 13, and the upper saddle 12 is then lowered for forging. The lubrication improves the material flow in the workpiece 20 in the surfaces in contact with the tool 12, 13, largely eliminates bulging at the sides, and ensures homogeneous forging. An increase in spread, also observed, makes the method in accordance with the invention also particularly suitable for the manufacture of flat material ("boards").

The lubricant films 30, 31 also reduce the otherwise relatively fast cooling of the workpiece 20, the friction coefficient and thus the power consumption. Where necessary, the lubricant coverings 30, 31 may be repaired or renewed by way of the nozzles 21 to 24 between deformation steps (bites). It is also possible to apply another covering of lubricant to one or both of the existing coverings 30, 31 by means of the vertically movable nozzles 21 to 24. Besides optical monitoring of the lubricant films and of their thickness, it is possible, within the scope of the invention, to use suitable sensors for automatic monitoring.

The method according to the invention and apparatus for performing it may also be used for open-die forging of other metals and metal alloys, for example, aluminum, titanium or nickel-based alloys.

We claim:

1. A method of forging a workpiece in an open-die forging press, comprising the steps of:

heating the workpiece to a forging temperature;

applying a glass lubricant to said heated workpiece to cover said heated workpiece so as to form thereon a uniform glass film coating providing effective lubrication at said forging temperature; and forging said heated workpiece having said glass film coating thereon in said open-die forging press.

2. The method according to claim 1, wherein said glass lubricant is applied to said heated workpiece as a fine powdered glass.

3. The method according to claim 2, wherein said fine powdered glass has a grain size in the range of 0.04–0.08 mm.

4. The method according to claim 2, wherein said fine powdered glass has a grain size less than 0.08 mm.

5. The method according to claim 1, wherein said glass lubricant is applied to said heated workpiece as an aqueous solution containing fine powdered glass.

6. The method according to claim 5, wherein said fine powdered glass has a grain size in the range of 0.04–0.08 mm.

7. The method according to claim 5, wherein said fine powdered glass has a grain size less than 0.08 mm.

8. The method according to claim 1 wherein said glass film coating is fluid at said forging temperature.

9. The method according to claim 1, wherein said glass film coating is plastic at said forging temperature.

10. The method according to claim 1, wherein said glass film coating is viscous at said forging temperature.

11. The method according to claim 1, wherein said glass lubricant is applied to said heated workpiece so as to form said lubricating glass film coating thereon on all surfaces thereof subject to contact by a forging tool during forging of said workpiece.

12. The method according to claim 1, wherein said glass lubricant is applied by spraying onto said heated workpiece.

13. The method according to claim 1, wherein said glass film coating formed on said heated workpiece has a thickness in the range of 100–300 μm.

14. The method according to claim 1, wherein said glass lubricant is applied to said heated workpiece immediately before forging.

15. The method according to claim 1, wherein said glass lubricant is applied to gradually coat said heated workpiece during feeding of said heated workpiece into the forging press.

16. The method according to claim 1, wherein said heated workpiece is rotated while said glass lubricant is being applied thereto.

17. The method according to claim 2, wherein said glass lubricant is applied to said heated workpiece by blowing.

18. The method according to claim 2, wherein said glass lubricant is applied to said heated workpiece by sprinkling.

19. The method according to claim 2, wherein said glass lubricant is applied to said heated workpiece by spraying.

20. The method according to claim 1, wherein said glass lubricant is applied to said heated workpiece in a plurality of layers.

21. The method according to claim 1, comprising the further steps of:

applying additional glass lubricant to said heated workpiece to renew said glass film coating thereon after initial forging; and forging said heated workpiece having said renewed glass film coating thereon.

22. The method according to claim 1, comprising the additional steps of:

allowing said glass film coating on said workpiece to solidify; and removing the solidified glass film coating from said workpiece by sandblasting.

23. In an open-die forging method comprising the steps of heating a metal workpiece to a forging temperature, placing the heated workpiece in a press frame of said open-die forging press between a first saddle and a second saddle carried respectively by a first saddle-carrier and a second saddle-carrier, and forging the heated workpiece in said open-die forging press by driving one saddle, by means of its carrier, toward the other saddle, the improvement wherein a glass lubricant is applied to the workpiece after the heating step but before the forging step to form a lubricating glass film between the respective surfaces of the workpiece and both saddles.

24. The method according to claim 23, wherein said one saddle is an upper saddle and said other saddle is a lower saddle

* * * * *